US006371555B1

(12) United States Patent
Edwards et al.

(10) Patent No.: US 6,371,555 B1
(45) Date of Patent: Apr. 16, 2002

(54) LOUNGE CHAIR BACKREST WITH A THREE DIMENSIONAL DESIGN

(75) Inventors: Beth A. Edwards, Miami Beach, FL (US); Bruce Lu, Taipei (TW)

(73) Assignee: Atico International USA, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/667,156

(22) Filed: Sep. 21, 2000

(51) Int. Cl.[7] ..... A47C 31/00

(52) U.S. Cl. ..... 297/228.1; 297/445.1; 297/463.1

(58) Field of Search ..... 297/228.1, 445.1, 297/463.1; D6/361

(56) References Cited

U.S. PATENT DOCUMENTS

| | | | | | |
|---|---|---|---|---|---|
| 3,829,998 | A | * | 8/1974 | Flax | 40/800 |
| 4,232,477 | A | * | 11/1980 | Lin | 446/71 |
| 4,536,028 | A | * | 8/1985 | Jones et al. | 297/224 |
| 4,694,511 | A | * | 9/1987 | Estes et al. | 2/69 |
| 4,774,735 | A | * | 10/1988 | Sanderson et al. | 5/655.3 |
| 4,892,353 | A | * | 1/1990 | Goddard | 297/224 |
| 5,246,265 | A | * | 9/1993 | Nagan et al. | 297/54 |
| D342,838 | S | * | 1/1994 | Peterson | D6/361 |
| D343,069 | S | * | 1/1994 | Trudo et al. | D6/361 |
| 5,367,801 | A | * | 11/1994 | Ahn | 40/714 |
| D353,060 | S | * | 12/1994 | Erickson | D6/361 |
| 5,527,091 | A | * | 6/1996 | Gruber | 297/188.01 |

FOREIGN PATENT DOCUMENTS

| | | | |
|---|---|---|---|
| JP | 08-99397 | * | 4/1996 |
| JP | 09-323381 | * | 12/1997 |
| JP | 2001-58498 | * | 3/2001 |

* cited by examiner

*Primary Examiner*—Peter M. Cuomo
*Assistant Examiner*—Joseph Edell
(74) *Attorney, Agent, or Firm*—Cobrin & Gittes

(57) ABSTRACT

A backrest of a lounge chair that has an open frame partially shrouded by a sheath. The sheath has a light transmissive front half. The rear half has a decorative design element and the front half has a decorative design element. The two decorative design elements are spaced from each other so that when looking through the light transmissive front half, both decorative design elements may be seen with the decorative design element on the rear half appearing to be further away than the decorative design element on the front half.

17 Claims, 3 Drawing Sheets

20
40
32
30
22
24
34
36
28
38
32
14
26
28
12

LOUNGE CHAIR BACKREST WITH A THREE DIMENSIONAL DESIGN

BACKGROUND OF THE INVENTION

1. Field of the Invention

The invention relates to a backrest of a lounge chair having a three-dimensional design.

2. Discussion of Related Art

Lounge chairs, also referred to as beach chairs, patio chairs, leisure chairs or lawn chairs, may be foldable. If foldable, they may be readily stored away or transported and then unfolded for use elsewhere. Their backrests typically include an open frame with either a fabric or plastic strips crossing the open frame to provide support to one's back while sitting. Sometimes designs are imprinted on them. The plastic strips or fabric present a generally planar surface so the designs printed on them only provide a two-dimensional look. However, providing a three dimensional look to the design would enhance the aesthetic effect.

BRIEF SUMMARY OF THE INVENTION

One aspect of the invention resides in a backrest of a lounge chair that has an open frame partially shrouded by a sheath. The sheath has a light transmissive front half and a rear half. The rear half has a decorative design element and the front half has a decorative design element. The two decorative design elements are spaced from each other, with the one on the front half appearing to be closer than the other on the rear half of the sheath when looking through the light transmissive front half.

BRIEF DESCRIPTION OF THE SEVERAL VIEWS OF THE DRAWING

For a better understanding of the present invention, reference is made to the following description and accompanying drawings, while the scope of the invention is set forth in the appended claims.

DETAILED DESCRIPTION OF THE INVENTION

Figure 1:
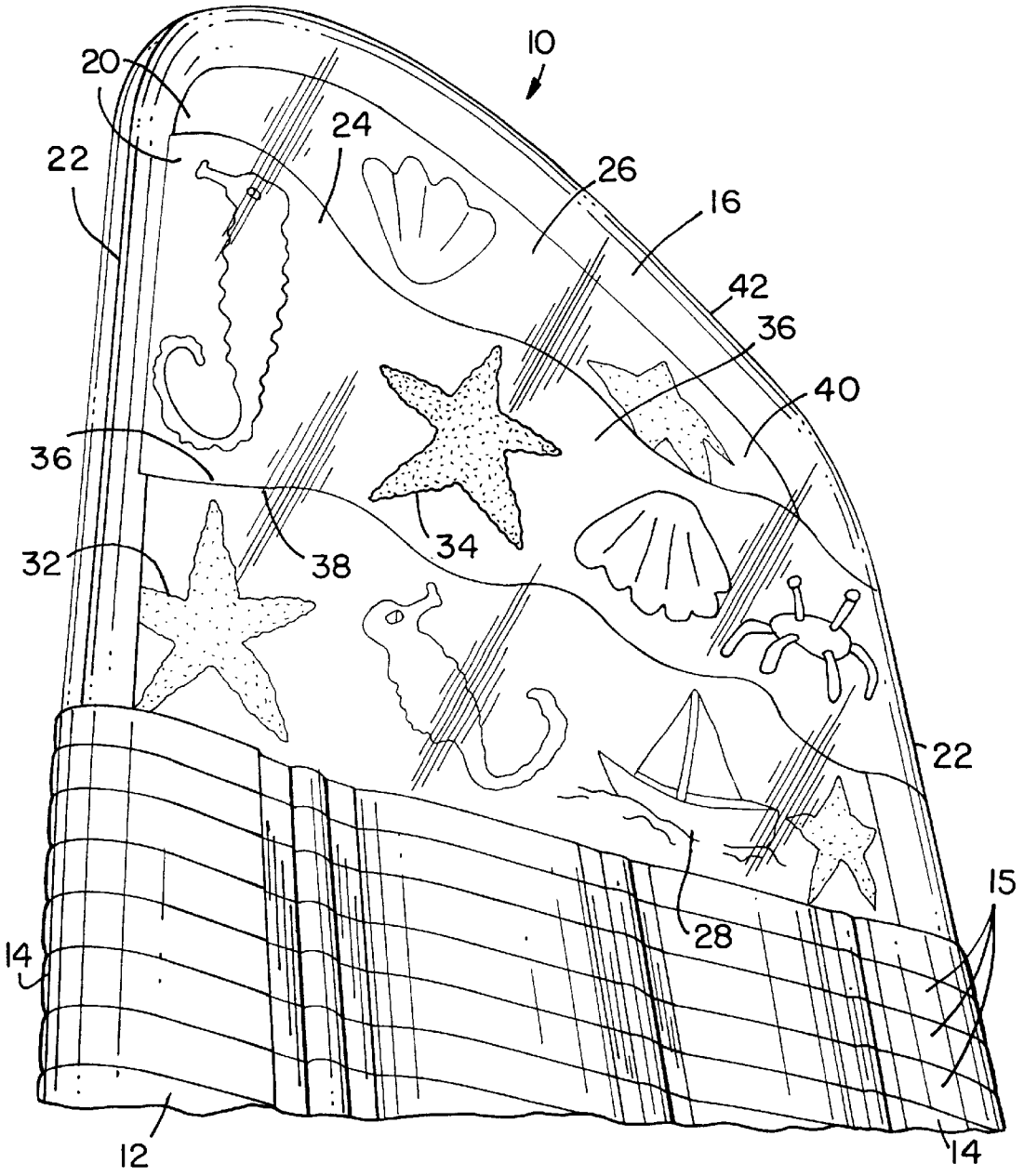
FIG. 1 is a perspective view of a backrest of a lounge chair in accordance with an embodiment of the invention.
Figure 2:
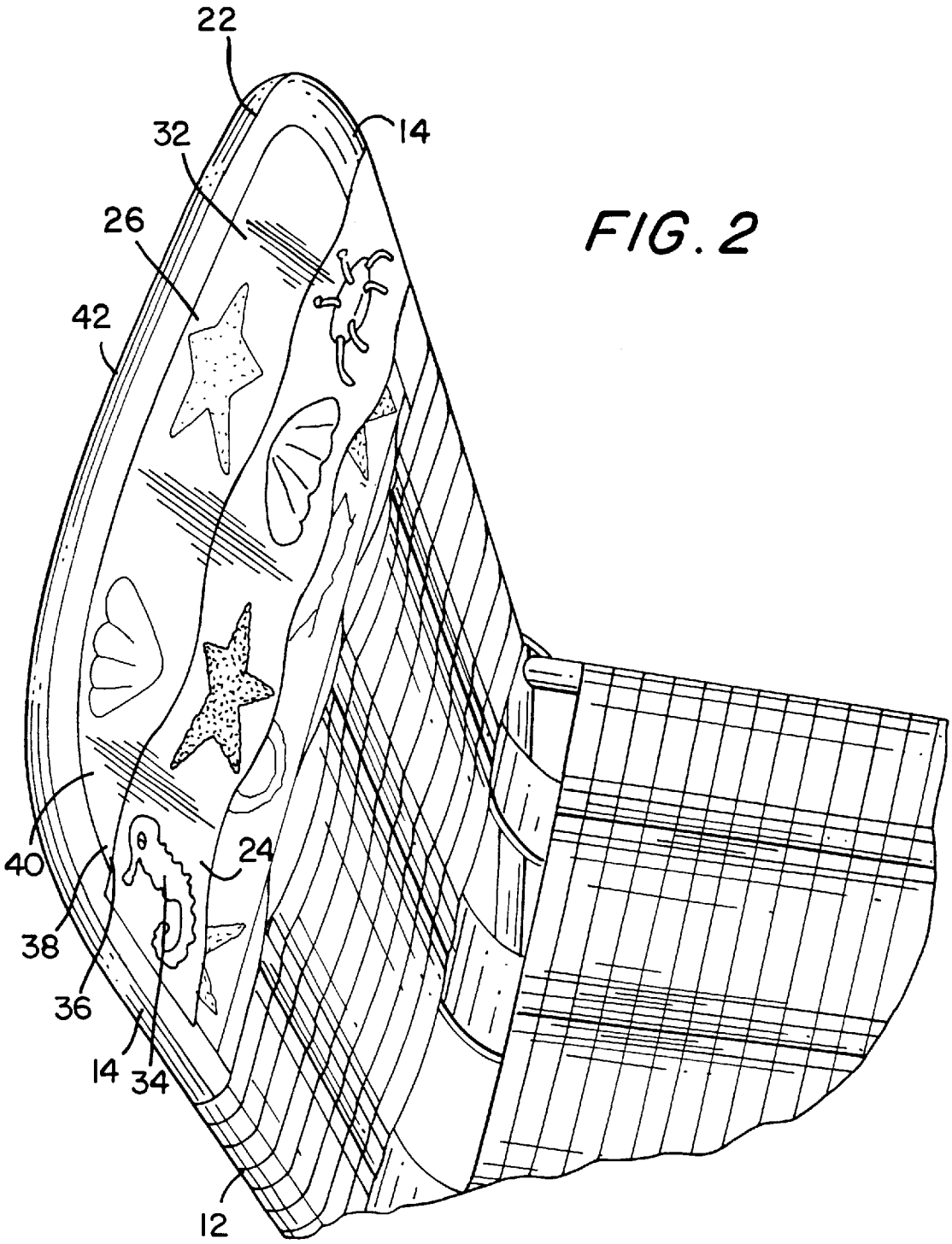
FIG. 2 is a top perspective view of the backrest of the lounge chair of FIG. 1.
Figure 3:
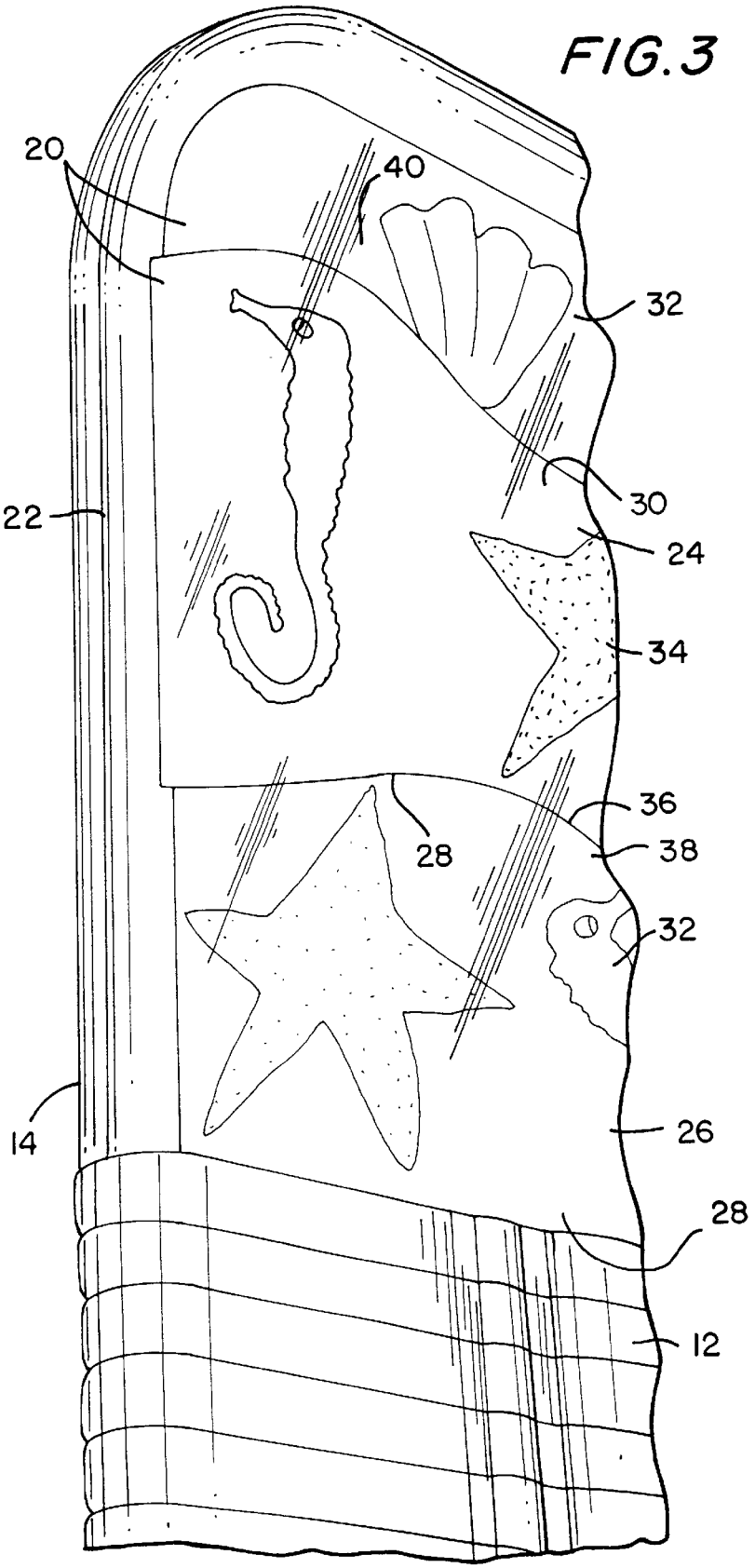
FIG. 3 is an enlargement of a portion of FIG. 1.

Turning to the drawing, FIGS. 1–3 show a backrest 10 of a lounge chair. The backrest 10 includes a back support 12 in the form of conventional plastic strips 15 wrapped around sides 14 of a conventional open frame 16 in a conventional manner. Such is exemplified in U.S. Pat. No. 4,536,028, whose contents are incorporated herein by reference. Alternatively, the back support 12 may be a fabric material, as exemplified in U.S. Pat. No. 6,062,648, whose contents are incorporated herein by reference.

Regardless of the construction of the back support 12, in accordance with the invention, the back support 12 is dimensioned to only close at most a portion of the space between the sides 14 of the open frame 16. A sheath 20, preferably formed of plastic or fabric material, may be wrapped around the front and back of the open frame 16 to close a further portion of the space. The sheath 20 has two halves 26, 40 that are shaped to conform with the contour of the open frame 16 along the sides 14 and top crosspiece 42 of the open frame and are thermally welded together where their peripheries 22 meet along the contour of the open frame 16.

In addition, a strip 24, which may be a separate element or merely printed on the front half of the sheath, is provided to appear to span the space between the sides 14. If provided as a separate element, it may flush against the front half 40 of the sheath 20. The front and back halves of the sheath 20 have respective inner faces 28 that faces each other and respective outer faces 30 that face away from each other. The material of the back half 26 of the sheath may be either opaque, translucent or transparent, and made from plastic or cloth material.

An inner decorative design 32 is arranged on at least one of the inner faces 28 and an outer decorative design 34 is arranged on at least another of the outer faces 30. Both the inner and outer decorative designs 32, 34 are visible to an observer simultaneously when the observer is only looking through the front half 40 of the sheath 20. The inner decorative design 32 appears as a backdrop to the outer decorative design 34 because of their relative positions with respect to each other, thereby providing a three dimensional look overall.

If the strip 24 is provided as a separate element, it may be smaller in height dimension than the back portion 26 so that an observer, when looking through the front half 40 of the sheath 20, with the strip 24 being closer to the observer than the back half 26 of the sheath 20, may see both decorative designs 32, 34 at the same time. The strip 24 may be made of a plastic or cloth material and be either opaque, translucent or transparent.

An advantage of the present invention is shading effects, which are not available for conventional two dimensional designs. The strip 24, whether printed or a separate element, has an edge 36, which may contribute to the outer decorative design 34 or be a separate design by itself. For instance, the edge 36 may have a wavy look as shown in the drawings to complement the aquatic design of sea creatures. When light shines on this edge (such as from the sun), a shadow 38 forms on the inner face 28 that has the inner decorative design 32. As a result, such a shadow effect helps provide the realism of a three dimensional look.

The sheath 20 need not be sealed along its bottom edge. Instead, it may extend beneath the top portion of the back support 12, e.g., it may be sheathed by the top plastic strips 15, and secured to the back support 12. The front half 40 of the sheath 20 may be light transmissive, that is, transparent or translucent, preferably made of plastic.

Where plastic strips are used as the back support 12, the same fastening technique used to secure the plastic strips 15 to each other in their center regions is used to secure the bottom portion of the back half 26 and the front half 40, such as by thermal welding so that they are to some extent taut as opposed to floppy. Further, each has memory that helps maintain their shape. After being pressed toward each other, for instance, their memory resiliently restores them to their original shape when the pressure is released As a consequence of this construction, the inner and outer decorative designs 32, 34 are contained within the sheath 20, which protects them from weather elements.

If desired, the strip 24 may be dispensed with and its decorative design 34 placed instead on the inner facing side of the front half 40 of the sheath 20. The front half 40 may be printed upon on its inner facing side with the contour of the strip to give the appearance of the strip spanning between the sides.

The decorative design elements convey artistic expression that is recognizable to the observer, such as in the form of outlines of objects, animals or plants, They may be arranged on the outer or inner face of the front half 40 or on the outer or inner face of the back half 26.

While the foregoing description and drawings represent the preferred embodiments of the present invention, it will be understood that various changes and modifications may be made without departing from the spirit and scope of die present invention.

What is claimed is:

1. A backrest of a lounge chair, comprising an open frame that has at least two spaced apart sides that define a space between the sides, each of the sides having a width;

a sheath that spans the space between the sides and shrouds the open frame, the sheath conforming in shape to a contour of the sides, the sheath having front and rear halves that are separated from each other as they span the space between the sides, the front half being light transmissive, the front half and the back half of the sheath each having inner faces that face each other and outer faces that face away from each other; and at least two decorative design elements, one of the decorative design elements being on the inner face of the front half of the sheath and another of the decorative design elements being on the inner face of the rear half of the sheath such that the decorative design element on the inner face of the rear half appears further away than does the decorative design element on the inner face of the front half when viewed through the outer face of the front half of the sheath.

2. A backrest as in claim 1, wherein at least one of the halves of the sheath is translucent.

3. A backrest as in claim 1, wherein at least one of the halves of the sheath is transparent.

4. A backrest as in claim 1, wherein the rear half of the sheath is opaque.

5. A backrest as in claim 1, wherein the two decorative design elements cooperate with each other to provide a three dimensional look.

6. A backrest as in claim 1, wherein the front half of the sheath is transparent and the rear half of the sheath is either translucent or opaque.

7. A backrest as in claim 6, wherein the open frame has a crosspiece that runs between the sides, the sheath being wrapped around the crosspiece and conforming in shape to the crosspiece where the sheath wraps around.

8. A backrest as in claim 1, wherein the front and rear halves of the sheath are thermally welded together.

9. A backrest as in claim 1, further comprising a back support spanning the space between the two sides and being secured to the sheath.

10. A backrest as in claim 1, wherein the back support is composed of a plurality of plastic strips each spanning the space between the two sides, at least some of the plastic strips being thermally welded to the sheath.

11. A backrest of a lounge chair, comprising an open frame that has at least two spaced apart sides that define a space between the sides, each of the sides having a width;

a sheath that spans the space between the sides and shrouds the open frame, the sheath conforming in shape to a contour of the sides, the sheath having front and rear halves are separated from each other, the front half being light transmissive;

a strip spanning between the sides and contained within the sheath and being closer to the front half than to the rear half of the sheath as the strip spans the sides, the strip and the rear half of the sheath each having inner faces that face each other and outer faces that face away from each other;

at least two decorative design elements, one of the decorative design elements being on the inner face of one of the rear half of the sheath and the other of the decorative design elements being on the outer face of the strip such that the decorative design element on the inner face appears further away than does the decorative design element on the outer face when viewed through the front half of the sheath.

12. A backrest as in claim 11, wherein the strip is transparent.

13. A backrest as in claim 11, wherein the strip is translucent.

14. A backrest as in claim 11, wherein the strip is opaque.

15. A backrest as in claim 11, wherein the design element that is on the inner face of the back half of the sheath is a background and the design element that is on the outer face of the strip is a foreground such that the background and foreground cooperate with each other to provide a three dimensional look.

16. A backrest of a lounge chair, comprising an open frame that has at least two spaced apart sides that define a space between the sides, each of the sides having a width;

a sheath that spans the space between the sides and shrouds the open frame, the sheath conforming in shape to a contour of the sides, the sheath having front and rear halves that are separated from each other as they span the space between the sides, the front half being light transmissive; and at least two decorative design elements, one of the decorative design elements being on the front half of the sheath and another of the decorative design elements being on the rear half of the sheath.

17. A backrest as in claim 16, wherein the design element that is on the front half of the sheath is a foreground and the design element that is on the rear half of the sheath is a background such that the foreground and the background cooperate with each other to provide a three dimensional look.

* * * * *